US010548384B1

(12) United States Patent
Wang

(10) Patent No.: US 10,548,384 B1
(45) Date of Patent: Feb. 4, 2020

(54) VACUUMED CONTAINER

(71) Applicant: Chiu-Pei Wang, New Taipei (TW)

(72) Inventor: Chiu-Pei Wang, New Taipei (TW)

(73) Assignee: Chiu-Pei Wang, New Taipei (TW)

( * ) Notice: Subject to any disclaimer, the term of this patent is extended or adjusted under 35 U.S.C. 154(b) by 0 days.

(21) Appl. No.: 16/120,444

(22) Filed: Sep. 3, 2018

(51) Int. Cl.
*B05B 11/00* (2006.01)
*A45D 34/00* (2006.01)

(52) U.S. Cl.
CPC ..... *A45D 34/00* (2013.01)

(58) Field of Classification Search
CPC ..... B05B 11/3052; B05B 11/0064; B05B 11/3023; B05B 11/3069; B05B 11/00416; A45D 2200/054; A45D 34/00; B65B 11/3078
USPC ..... 222/209
See application file for complete search history.

(56) References Cited

U.S. PATENT DOCUMENTS 4,946,076 A * 8/1990 Hackmann ..... B05B 11/0067 222/207
9,681,731 B2 * 6/2017 Jo ..... B05B 11/3052
2014/0231464 A1 * 8/2014 Cho ..... B05B 11/0038 222/321.8
2017/0065055 A1 * 3/2017 Kim ..... A45D 34/04
2018/0345305 A1 * 12/2018 Wong ..... B05B 11/3008

* cited by examiner

*Primary Examiner* — Paul R Durand
*Assistant Examiner* — Robert K Nichols, II

(57) ABSTRACT

A vacuumed container includes a container main body having an open end, a closed end and a receiving space receiving a piston. A connection member is disposed on the open end and has a first valve member. The piston and the connection member define a first chamber. The piston and the closed end define a second chamber. A pressurized cap is disposed at the open end and has a pressurized section and a second installation hole. An upper cap caps the pressurized cap and has a second installation sink and a second valve member and an abutment ring in contact with the pressurized section. A first end of a connection component abuts against the inner side of the second installation sink. A second end of the connection component is disposed in the second installation hole. A flow way communicates with the second installation sink and the second installation hole.

17 Claims, 13 Drawing Sheets

VACUUMED CONTAINER

BACKGROUND OF THE INVENTION

1. Field of the Invention

The present invention relates generally to a vacuumed container, and more particularly to a container structure, which has good sealability and can dispense constant amount of material with less residual.

2. Description of the Related Art

Currently, due to frequent social occasions and environments, peoples have more and more emphasized the care and maintenance of skin and look. In general, makeup remover, facial cleanser, lip cream, care products, cosmetics and the likes are used to cleanse or modify the skin so as to have a better look. The makeup remover, care products and cosmetics are generally contained in a bottle or a container.

The conventional container structure includes a container main body having a receiving space. The bottom section of the container main body has a perforation and the receiving space is often capped with a connection member. The connection member is equipped with a first valve member and a piston is movably disposed in the receiving space. A press cap is further disposed above the connection member. The connection member and the press cap define therebetween a chamber. The press cap has a press section and a second valve member. The press section has elasticity. In use, a user presses down the press section of the press cap to squeeze a cosmetic material in the chamber out of the second valve member of the press cap. When the user releases the press section of the press cap, the press section upward restores to its home position. At this time, the pressure in the chamber is smaller and the cosmetic material in the receiving space is squeezed out through the second valve member into the chamber. Under such circumstance, the pressure in the receiving space becomes smaller, whereby through the perforation, the piston can move upward to balance the pressure of the receiving space.

However, in the conventional container structure, the press section of the press cap is manually pressed by a user. Each time the user manually presses the press section, the user applies a different pressing force onto the press section. As a result, the amount of the dispensed cosmetic material varies. In case an excessive amount of cosmetic material is dispensed, the cosmetic material will be wasted. On the other hand, in case an insufficient amount of cosmetic material is dispensed, it will be necessary for the user to press the press section again. Moreover, each time the user uses the container structure, the user needs to manually apply a force to the press section to squeeze out the cosmetic material.

This is quite inconvenient in use. Furthermore, in order to keep the conventional container structure airtight and prevent the cosmetic material from being contaminated and deteriorated due to that the user directly takes out the cosmetic material from the receiving space with a finger, the first and second valve members are respectively disposed on the press cap and the connection member to keep the receiving space airtight. However, under such circumstance, it is impossible to open the press cap and the connection member. As a result, a great amount of residual cosmetic material will remain in the receiving space to lead to waste.

It is therefore tried by the applicant to provide a vacuumed container to solve the above problems existing in the conventional container structure.

SUMMARY OF THE INVENTION

It is therefore a primary object of the present invention to provide a vacuumed container, which has good sealability.

It is a further object of the present invention to provide the above vacuumed container, which can dispense constant amount of material.

It is still a further object of the present invention to provide the above vacuumed container, which can reduce the residual of the content in the receiving space without destroying the airtightness of the vacuumed container.

It is still a further object of the present invention to provide the above vacuumed container, which can be operated with less strength.

To achieve the above and other objects, the vacuumed container of the present invention includes: a container main body having an open end and a closed end, the open end and the closed end together defining a receiving space, the closed end being formed with at least one perforation; a connection member disposed on the open end, the connection member having a first installation sink, a first valve member being disposed in the first installation sink; a piston movably received in the receiving space and displaceable with the operation of the first valve member, the piston and the corresponding connection member defining therebetween a first chamber in communication with the first installation sink, the piston and the corresponding closed end defining therebetween a second chamber in communication with the at least one perforation, the first and second chambers being isolated from each other; a pressurized cap disposed at the open end of the container main body corresponding to the connection member, the pressurized cap and the connection member together defining a third chamber, the pressurized cap having a pressurized section and a second installation hole, the pressurized section being disposed on one side of the pressurized cap, the second installation hole passing through the pressurized cap in communication with the third chamber; an upper cap capping the pressurized cap, the upper cap having a top wall and a circumferential wall downward extending from a rim of the top wall, the top wall having a second installation sink corresponding to the second installation hole, a second valve member being disposed in the second installation sink, an inner side of the top wall having an abutment ring, one end of the abutment ring contacting the pressurized section, whereby the pressurized section is pressed by the abutment ring to elastically deform to make the second valve member operate therewith; and a connection component having a first end, a second end and a flow way passing through the first and second ends, the first end abutting against the inner side of the top wall along an outer rim of the second installation sink, the second end being disposed in the second installation hole of the pressurized cap, the flow way communicating with the second installation sink and the second installation hole.

According to the design of the present invention, the vacuumed container has good sealability and is able to dispense constant amount of material. Also, the vacuumed container has the effect that the residual of the content in the receiving space is reduced without destroying the airtightness of the vacuumed container.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
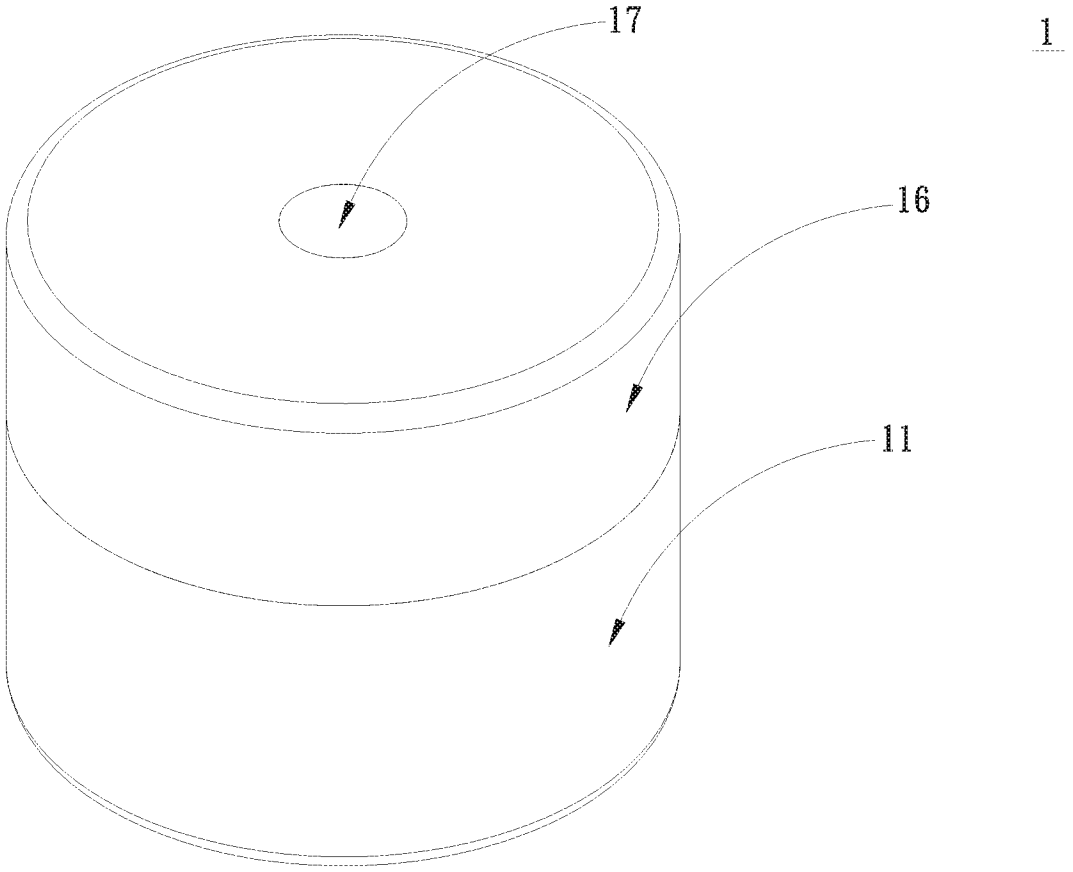
FIG. 1 is a perspective assembled view of a first embodiment of the vacuumed container of the present invention.
Figure 2:
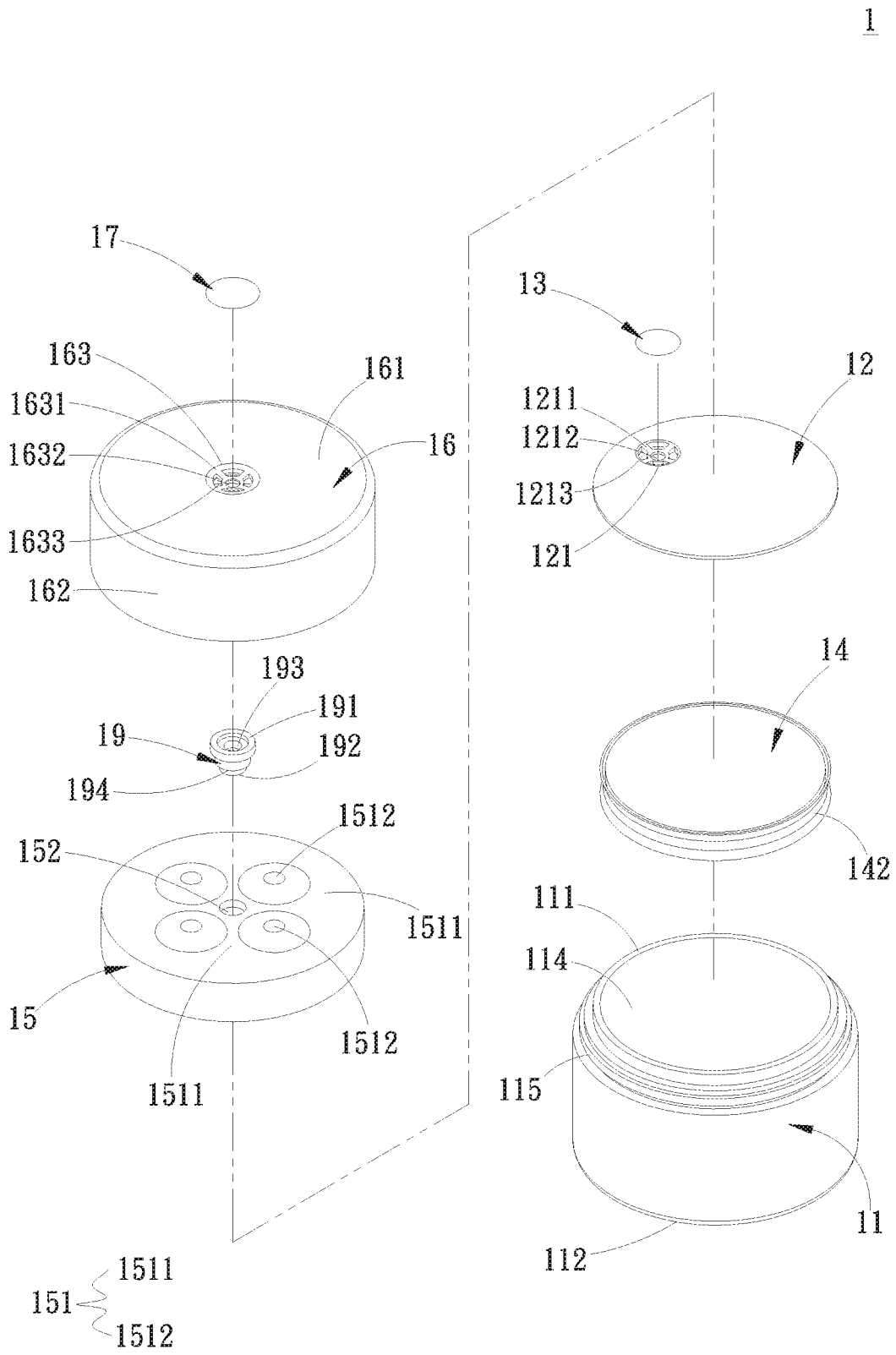
FIG. 2 is a perspective exploded view of the first embodiment of the vacuumed container of the present invention.
Figure 3:
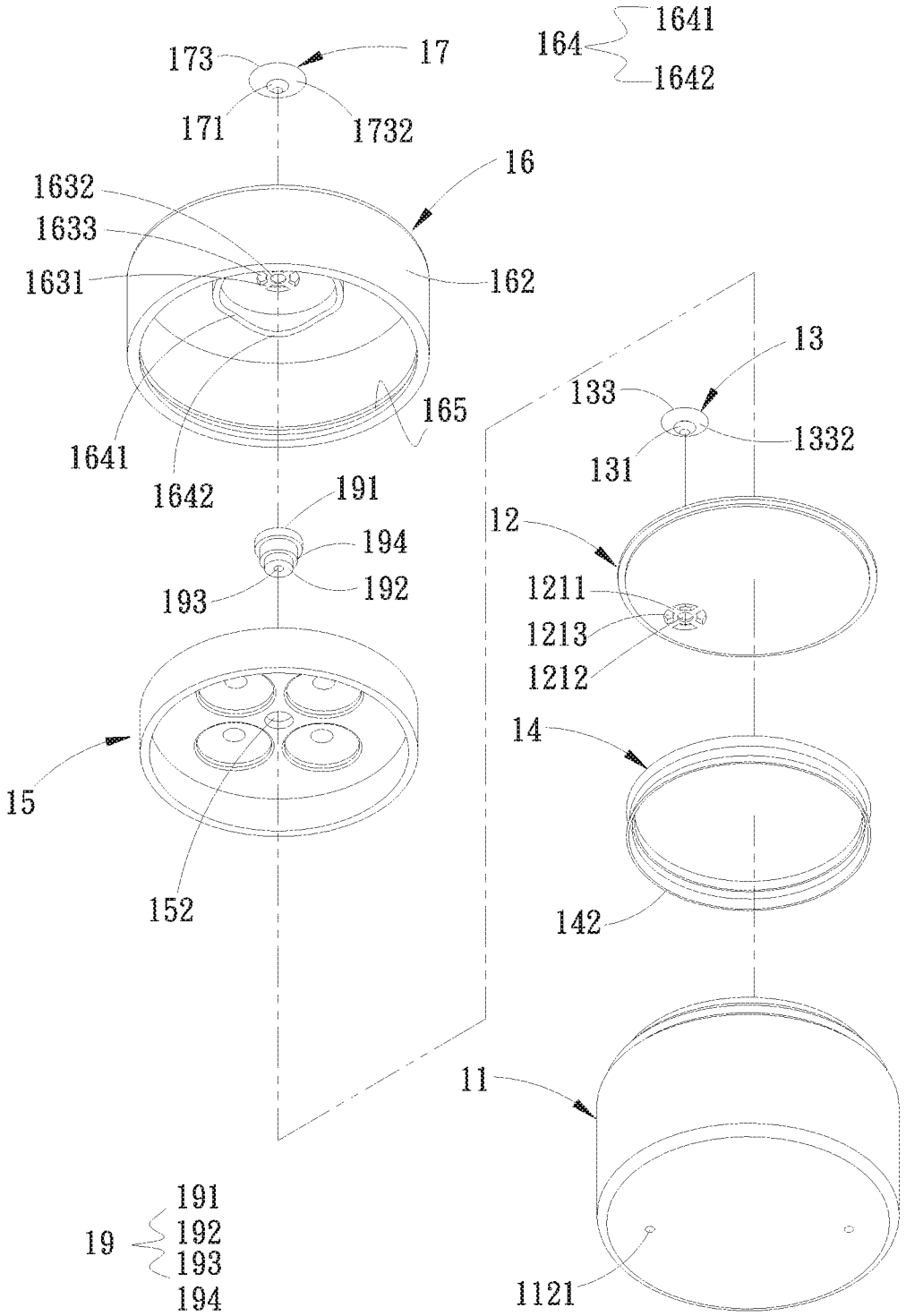
FIG. 3 is a perspective exploded view of the first embodiment of the vacuumed container of the present invention, seen from another angle.
Figure 4:
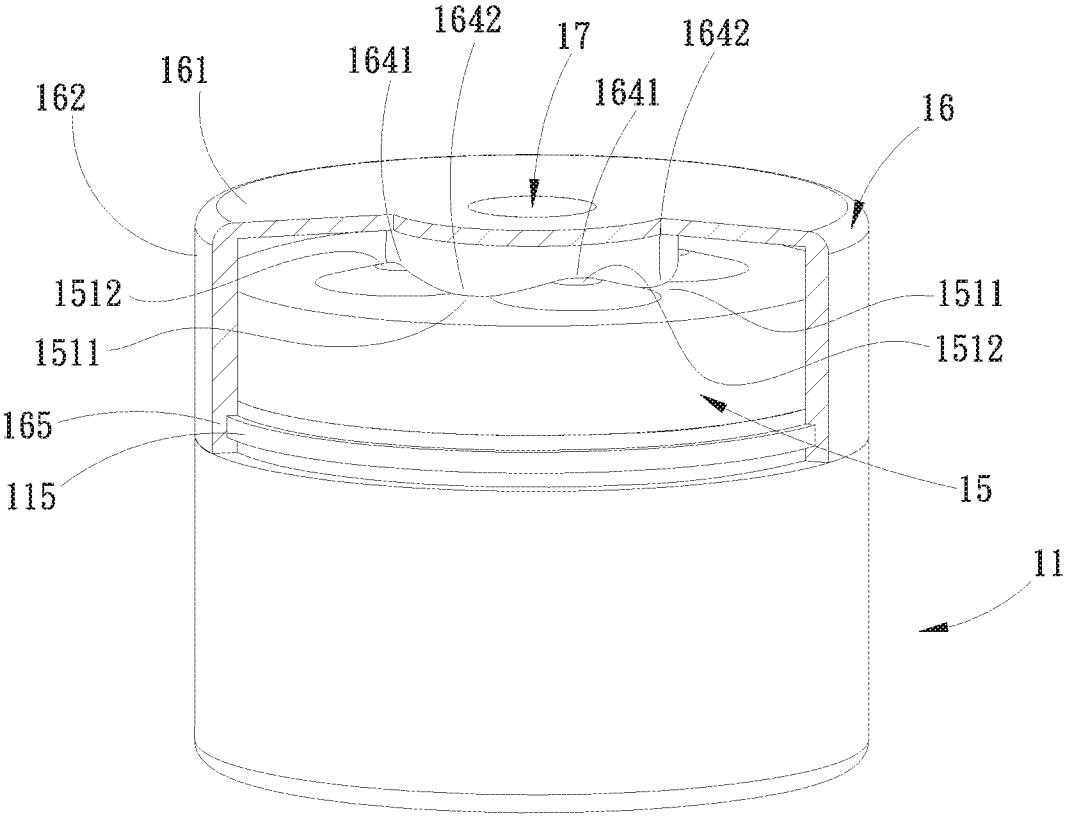
FIG. 4 is a perspective sectional assembled view of the first embodiment of the vacuumed container of the present invention.
Figure 5:
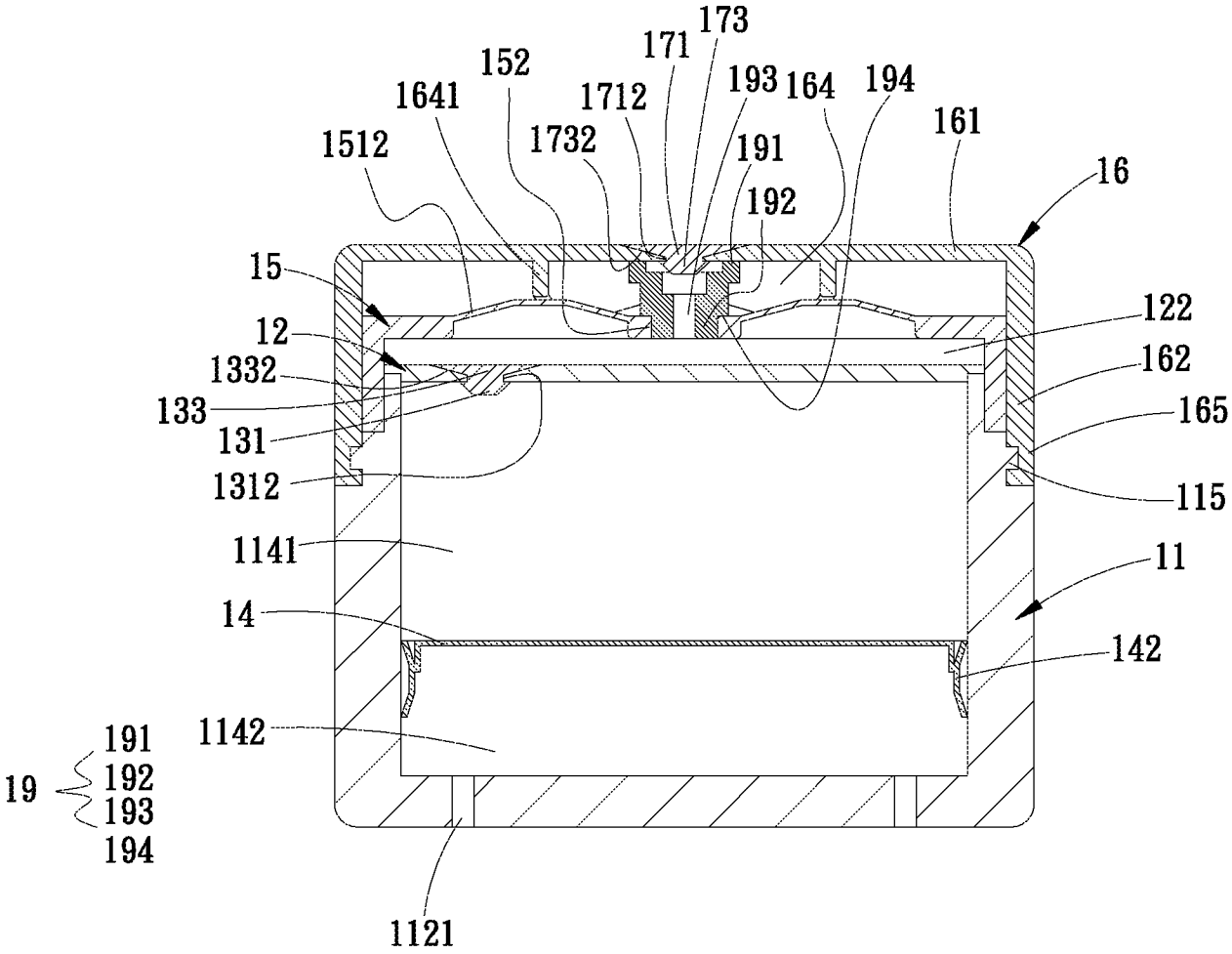
FIG. 5 is a sectional assembled view of the first embodiment of the vacuumed container of the present invention.

Please refer to FIGS. 1 to 5. FIG. 1 is a perspective assembled view of a first embodiment of the vacuumed container of the present invention. FIG. 2 is a perspective exploded view of the first embodiment of the vacuumed container of the present invention. FIG. 3 is a perspective exploded view of the first embodiment of the vacuumed container of the present invention, seen from another angle. FIG. 4 is a perspective sectional assembled view of the first embodiment of the vacuumed container of the present invention. FIG. 5 is a sectional assembled view of the first embodiment of the vacuumed container of the present invention. The vacuumed container 1 of the present invention includes a container main body 11, a connection member 12, a first valve member 13, a piston 14, a pressurized cap 15, an upper cap 16, a second valve member 17 and a connection component 19. The vacuumed container 1 is such as a container for makeup remover, facial cleanser, lip cream, care products or cosmetics.

The container main body 11 has an open end 111 and a closed end 112 respectively positioned at an upper end and a lower end of the container main body 11. The open end 111 and the closed end 112 together define a receiving space 114. The closed end 112 is formed with at least one perforation 1121. In this embodiment, the closed end 112 is, but not limited to, formed with two perforations 1121. In practice, the closed end 112 can be formed with more than two perforations 1121 or only one perforation 1121. An outer circumference of the open end 111 of the container main body 11 is formed with a first engagement section 115.

The connection member 12 is disposed on the open end 111 to seal the receiving space 114. The connection member 12 has a first installation sink 121. The first installation sink 121 has a first base seat 1211, a first installation hole 1212 and multiple first through holes 1213. The first installation hole 1212 and the first through holes 1213 pass through the first base seat 1211. The first valve member 13 is disposed in the first installation sink 121.

The first valve member 13 is disposed on one side of the first installation sink 121 distal from the receiving space 14. The first valve member 13 has a first support valve seat 131 and a first valve plate 133. The first support valve seat 131 protrudes from one side of the first valve plate 133 toward the receiving space 114. The first support valve seat 131 has a first depression 1312. The first depression 1312 is inward recessed along an outer side of the first support valve seat 131. The first support valve seat 131 passes through the first installation hole 1212 of the first installation sink 121, whereby the first depression 1312 is engaged with the first base seat 1211. The first valve plate 133 is made of an elastic plastic material or an elastic rubber material. The first valve plate 133 has a first contact face 1332 separably attached to the first base seat 1211 of the first installation sink 121. The first contact face 1332 can be elastically deformed to separate from the first base seat 1211 of the first installation sink 121.

The piston 14 is movably received in the receiving space 114 and is displaceable with the operation of the first valve member 13. An upper side of the piston 14 and the corresponding connection member 12 define therebetween a first chamber 1141 in communication with the first through holes 1213 of the first installation sink 121. A lower side of the piston 14 and the corresponding closed end 112 of the container main body 11 define therebetween a second chamber 1142 in communication with the at least one perforation 1121. The first and second chambers 1141, 1142 are isolated from each other without communicating with each other. The first chamber 1141 serves to receive therein a content 2 (such as a care lotion). The piston 14 is equipped with a sealing ring 142 disposed on an outer circumference of the piston 14. One side of the sealing ring 142 is tightly attached to an inner circumference of the container main body 11 so as to isolate the first and second chambers 1141, 1142 from each other. Therefore, the sealing ring 142 isolates the first chamber 1141 to prevent the air from flowing into the first chamber 1141, whereby the air cannot contact the content 2 so that the content 2 is prevented from deteriorating.

The pressurized cap 15 is disposed at the open end 111 of the container main body 11 corresponding to the connection member 12. In this embodiment, the connection member 12 is disposed at the open end 111 of the container main body 11 and the pressurized cap 15 caps the outer circumference of the connection member 12 to connect with the open end 111 of the container main body 11, whereby the pressurized cap 15 and the connection member 12 together define a third chamber 122.

The pressurized cap 15 is made of an elastic plastic material or an elastic rubber material. The pressurized cap 15 has a pressurized section 151 and a second installation hole 152. The pressurized section 151 is disposed on one side of the pressurized cap 15. The second installation hole 152 passes through the pressurized cap 15 in communication with the third chamber 122. The pressurized section 151 of the pressurized cap 15 has multiple first trough sections 1511 and multiple first crest sections 1512. The first crest sections

1512 protrude toward the upper cap 16. The first trough sections 1511 and the first crest sections 1512 are alternately arranged. In this embodiment, there are, but not limited to, four first trough sections 1511 and four first crest sections 1512. In a modified embodiment, the numbers of the first trough sections 1511 and the first crest sections 1512 can be otherwise.

The upper cap 16 caps the pressurized cap 15. The upper cap 16 has a top wall 161 and a circumferential wall 162 downward extending from a rim of the top wall 161. The top wall 161 has a second installation sink 163 corresponding to the second installation hole 152. The second installation sink 163 has a second base seat 1631, a third installation hole 1632 and multiple second through holes 1633. The third installation hole 1632 and the second through holes 1633 pass through the second base seat 1631. The second valve member 17 is disposed in the second installation sink 163. An inner side of the top wall 161 has an abutment ring 164. One end of the abutment ring 164 contacts the pressurized section 151, whereby the pressurized section 151 is pressed by the abutment ring 164 to elastically deform to make the second valve member 17 operate therewith. An inner circumference of the upper cap 16 has a second engagement section 165. The first engagement section 115 of the container main body 11 can be correspondingly rotatably engaged with the second engagement section 165. In this embodiment, the first engagement section 115 is, but not limited to, an annular rib, while the second engagement section 165 is, but not limited to, an annular groove. In a modified embodiment, the first engagement section 115 can be an annular groove, while the second engagement section 165 can be an annular rib. Moreover, in the drawings, there is no gap between the first and second engagement sections 115, 165. However, in practice, a gap can exist between the first and second engagement sections 115, 165, whereby the upper cap 16 can be more easily rotated relative to the container main body 11 and the pressurized cap 15. The upper cap 16 and the container main body 11 are, but not limited to, engaged each other, such that the first engagement section 115 can be correspondingly rotatably engaged with the second engagement section 165.

In this embodiment, the abutment ring 164 of the upper cap 16 has multiple second trough sections 1641 and multiple second crest sections 1642. The second crest sections 1642 protrude toward the pressurized cap 15. One end of the second crest sections 1642 serves to abut against and press the pressurized section 151. The second trough sections 1641 and the second crest sections 1642 are alternately arranged. In this embodiment, there are, but not limited to, four second trough sections 1641 and four second crest sections 1642 corresponding to the first trough sections 1511 and the first crest sections 1512. In a modified embodiment, the numbers of the second trough sections 1641 and the second crest sections 1642 corresponding to the first trough sections 1511 and the first crest sections 1512 can be otherwise.

The second valve member 17 is disposed on one side of the second installation sink 163. The second valve member 17 has a second support valve seat 171 and a second valve plate 173. The second support valve seat 171 protrudes from one side of the second valve plate 173 toward the pressurized cap 15. The second support valve seat 171 has a second depression 1712. The second depression 1712 is inward recessed along an outer side of the second support valve seat 171. The second support valve seat 171 passes through the third installation hole 1632 of the second installation sink 163, whereby the second depression 1712 is engaged with the second base seat 1631. The second valve plate 173 is made of an elastic plastic material or an elastic rubber material. The second valve plate 173 has a second contact face 1732 separably attached to the second base seat 1631 of the second installation sink 163. The second contact face 1732 can be elastically deformed to separate from the second base seat 1631 of the second installation sink 163.

The connection component 19 is made of an elastic plastic material or an elastic rubber material. The connection component 19 has a first end 191, a second end 192 and a flow way 193 passing through the first and second ends 191, 192. The first end 191 abuts against the inner side of the top wall 161 along an outer rim of the second installation sink 163. The second end 192 is disposed in the second installation hole 152 of the pressurized cap 15. The flow way 193 communicates with the second installation sink 163 and the second installation hole 152. In this embodiment, the outer circumference of the connection component 19 has a stepped section 194 positioned between the first and second ends 191, 192. The second end 192 is plugged in the second installation hole 152 of the pressurized cap 15. The stepped section 194 abuts against the upper side of the pressurized cap 15 along the outer rim of the second installation hole 152. The connection component 19 is elastic so that when the connection component 19 is compressed between the upper cap 16 and the pressurized cap 15, the third chamber 122 is kept airtight.

Figure 6:
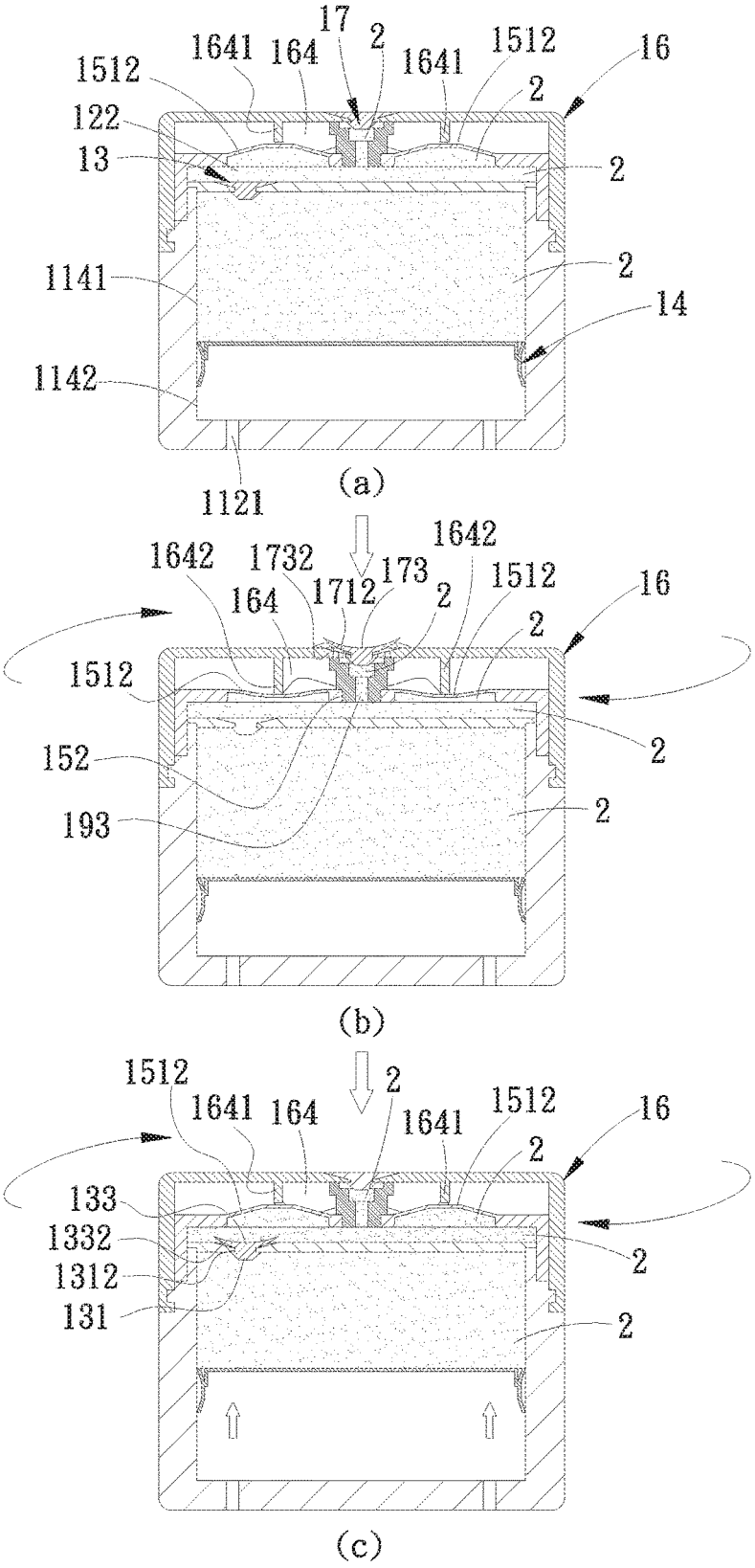
FIG. 6 is a view showing the operation of the first embodiment of the vacuumed container of the present invention.

A practical operation of the present invention will be described hereinafter. Please refer to FIG. 6*a* as well as FIGS. 1-5. When the vacuumed container 1 is in a not used state, the second trough sections 1641 of the abutment ring 164 of the upper cap 16 are positioned on the first crest sections 1512 of the pressurized section 151 of the pressurized cap 15, while the second crest sections 1642 are positioned on the first trough sections 1511. Please refer to FIG. 6*a*. When using the vacuumed container 1, the upper cap 16 is rotated to make the second crest sections 1642 of the abutment ring 164 displace onto the first crest sections 1512 of the pressurized section 151 to abut against and press the first crest sections 1512, while the second trough sections 1641 are positioned on the first trough sections 1511, whereby the first crest sections 1512 are elastically deformed to change the pressure in the third chamber 122. At this time, the content 2 in the third chamber 122 is squeezed to the second installation hole 152. Then the content flows into the flow way 193 of the connection component 19.

The only passage for the third chamber 122 to communicate with the external side is the second through holes 1633 of the second installation sink 163. Therefore, the content 2 in the flow way 193 will jam to the second through holes 1633. The depression 1712 of the second support valve seat 171 of the second valve member 17 is engaged with the second base seat 1631 of the second installation sink 163. Therefore, after the contact face 1732 of the second valve plate 173 of the second valve member 17 is pushed by the content 2, the contact face 1732 is separated from the second base seat 1631 of the second installation sink 163 to open to the external side. At this time, the content 2 in the flow way 193 flows out through the second through holes 1633 until the pressure in the third chamber 122 is balanced with the pressure of the external side. Thereafter, the second contact face 1732 of the second valve plate 173 is restored to attach to the second base seat 1631 again.

Please now refer to FIG. 6*c*. When the upper cap 16 is again rotated, the second trough sections 1641 of the abutment ring 164 are again displaced to the first crest sections 1512 of the pressurized section 151, whereby the first crest sections 1512 are restored to their original state and the pressure in the third chamber 122 is reduced. At this time, the pressure of the first chamber 1141 is greater than the pressure of the third chamber 122. The only passage for the first chamber 1141 to go to the third chamber 122 is the first through holes 1213 of the first installation sink 121. Therefore, the content 2 in the first chamber 1141 will jam to the first through holes 1213. The first depression 1312 of the first support valve seat 131 of the first valve member 13 is engaged with the base seat 1211 of the first installation sink 121. Therefore, after the first contact face 1332 of the first valve plate 133 of the first valve member 13 is pushed by the content 2, the first contact face 1332 is separated from the first base seat 1211 of the first installation sink 121 to open to the third chamber 122. At this time, the content 2 in the first chamber 1141 goes through the first through holes 1213 to supplement the third chamber 122.

Under such circumstance, the pressure in the first chamber 1141 is reduced. At this time, the pressure of the second chamber 1142 is greater than the pressure of the first chamber 1141. Therefore, the piston 14 is forced to move upward toward the first chamber 1141 until the pressure in the first chamber 1141 is balanced with the pressure in the second chamber. Thereafter, the first contact face 1332 of the first valve plate 133 is restored to attach to the first base seat 1211 again and the piston 14 stops moving upward.

According to the design of the vacuumed container 1 of the present invention, the vacuumed container 1 can be effectively kept well sealed. In this case, the content 2 is prevented from contacting air. In addition, by means of the structural design of the second crest sections 1642 of the abutment ring 164, each time a user rotates the upper cap 16, a constant amount of content 2 is squeezed out so as to avoid waste. Moreover, the first trough sections 1511 and the first crest sections 1512 of the elastic pressurized section 151 of the pressurized cap 15 are alternately arranged. Also, the second trough sections 1641 and the second crest sections 1642 of the abutment ring 164 of the upper cap 16 are alternately arranged. In addition, the first engagement section 115 of the container main body 11 and the second engagement section 165 of the upper cap 16 are engaged with each other. According to such design, when rotating the upper cap 16, the axial height of the container main body 11 and the upper cap 16 is kept unchanged, whereby the second crest section 1642 can displace by a distance of the second trough section 1641 to intermittently abut against and press the first crest section 1512. Therefore, a user can squeeze out the content 2 without using any finger to save strength.

Figure 7:
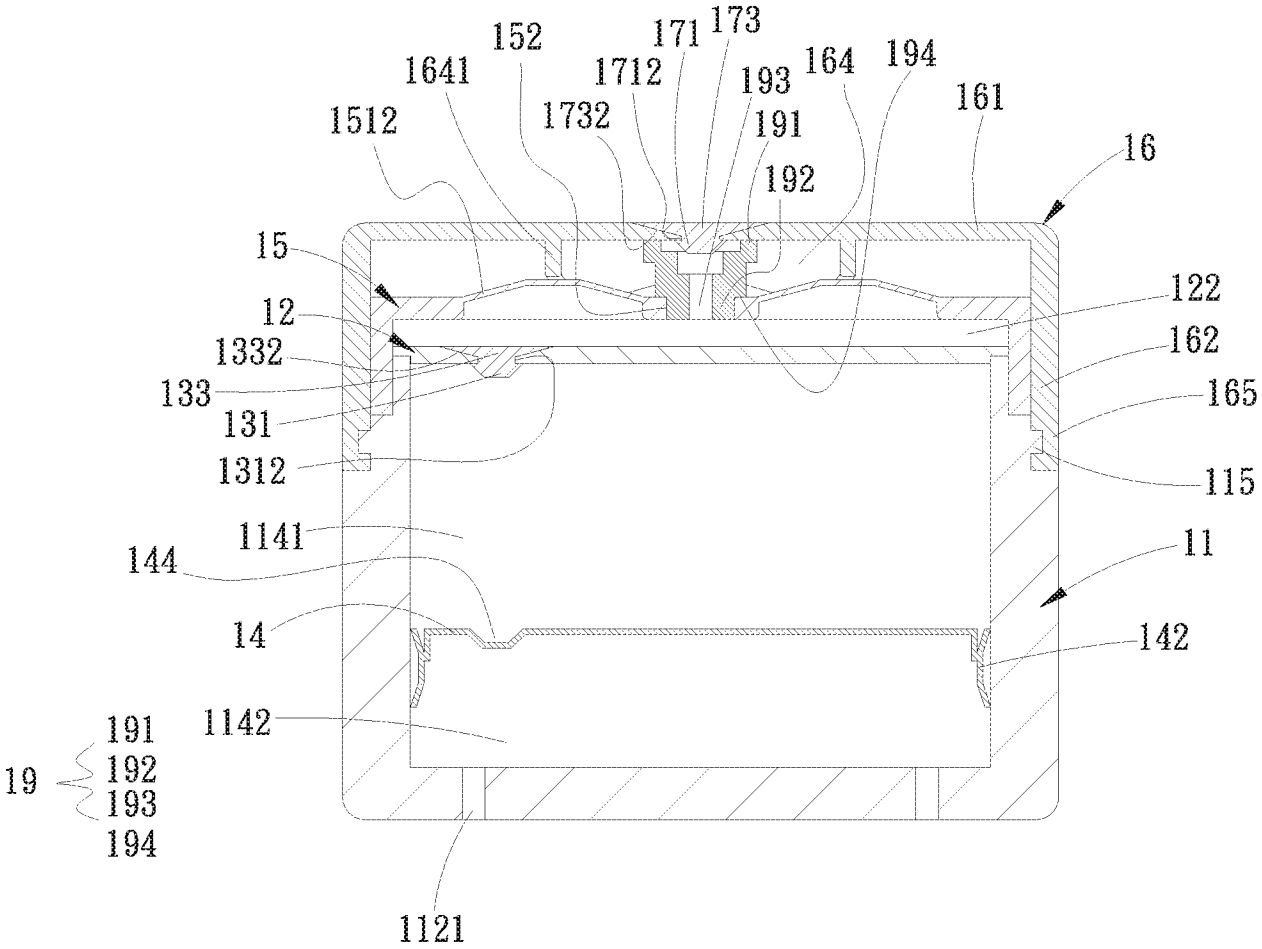
FIG. 7 is a sectional assembled view of a second embodiment of the vacuumed container of the present invention.
Figure 8:
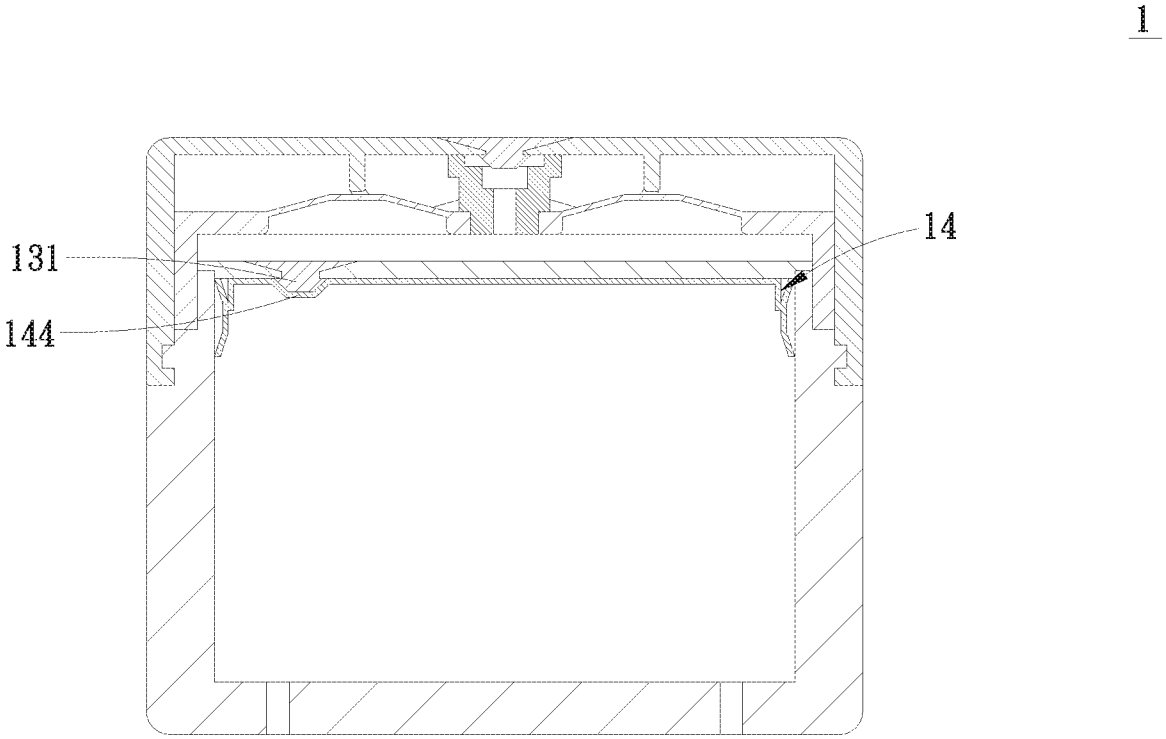
FIG. 8 is a view showing the operation of the second embodiment of the vacuumed container of the present invention.

Please now refer to FIGS. 7 and 8. FIG. 7 is a sectional assembled view of a second embodiment of the vacuumed container of the present invention. FIG. 8 is a view showing the operation of the second embodiment of the vacuumed container of the present invention. Also referring to FIGS. 1-6, the second embodiment is partially identical to the first embodiment in structure and function and thus will not be redundantly described hereinafter. The second embodiment is different from the first embodiment in that the piston 14 is formed with a first recess 144 in a position corresponding to the first support valve seat 131. The first recess 144 is downward recessed toward the second chamber 1142. The configuration of the first support valve seat 131 protruding toward the first chamber 1141 is identical to the configuration of the first recess 144 downward recessed toward the second chamber 1142. In addition, the first support valve seat 131 can be correspondingly separably connected with the first recess 144.

When using the content 2 in the first chamber 1141, the piston 14 will continuously move upward under pressure until the content 2 in the first chamber 1141 is exhausted. At this time, the connection member 12 will connect with the piston 14 and the first support valve seat 131 of the first valve member 13 will correspondingly attach to the first recess 144 of the piston 14. Under such circumstance, the content 2 in the first chamber 1141 can be totally squeezed out to the third chamber 122 without residual.

Figure 9:
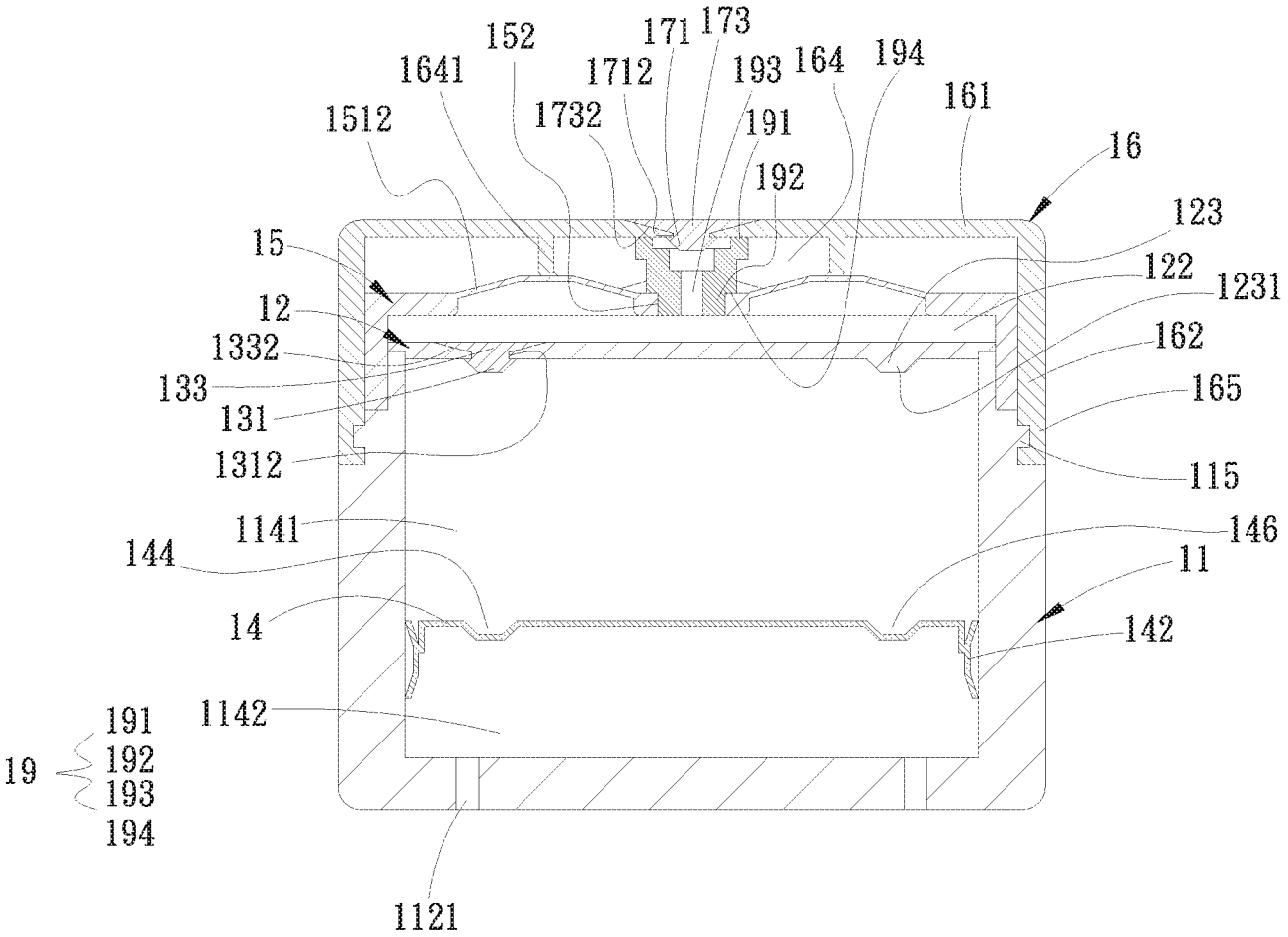
FIG. 9 is a sectional assembled view of a third embodiment of the vacuumed container of the present invention.

Please now refer to FIG. 9, which is a sectional assembled view of a third embodiment of the vacuumed container of the present invention. Also referring to FIGS. 1-8, the third embodiment is partially identical to the second embodiment in structure and function and thus will not be redundantly described hereinafter. The third embodiment is different from the second embodiment in that the connection member 12 is formed with a balancing block 123 in a position symmetrical to the first installation sink 121. The balancing block 123 protrudes toward the first chamber 1141.

The balancing block 123 has a protrusion section 1231. In this embodiment, the balancing block 123 is disposed in a position 180-degree symmetrical to the first installation sink 121. In addition, the configuration of the protrusion section 1231 protruding toward the first chamber 1141 is identical to the configuration of the first support valve seat 131 of the first valve member 13. The piston 14 is formed with a second recess 146 in a position symmetrical to the first recess 144. The second recess 146 is downward recessed toward the second chamber 1142. The configuration of the balancing block 123 protruding toward the first chamber 1141 is identical to the configuration of the second recess 146 downward recessed toward the second chamber 1142. In addition, the protrusion section 1231 of the balancing block 123 can be correspondingly separably connected with the second recess 146.

When using the content 2 in the first chamber 1141, the piston 14 will continuously move upward under pressure until the content 2 in the first chamber 1141 is exhausted. At this time, the connection member 12 will connect with the piston 14 and the first support valve seat 131 of the first valve member 13 will correspondingly attach to the first recess 144 of the piston 14. Also, the protrusion section 1231 of the balancing block 123 will correspondingly attach to the second recess 146 of the piston 14. Under such circumstance, the content 2 in the first chamber 1141 can be totally squeezed out to the third chamber 122 without residual. In addition, when moving upward, the piston 14 can keep in balance so that the first support valve seat 131 will not fail to correspondingly connect with the first recess 144 due to unbalanced weight of the piston 14.

Figure 10:
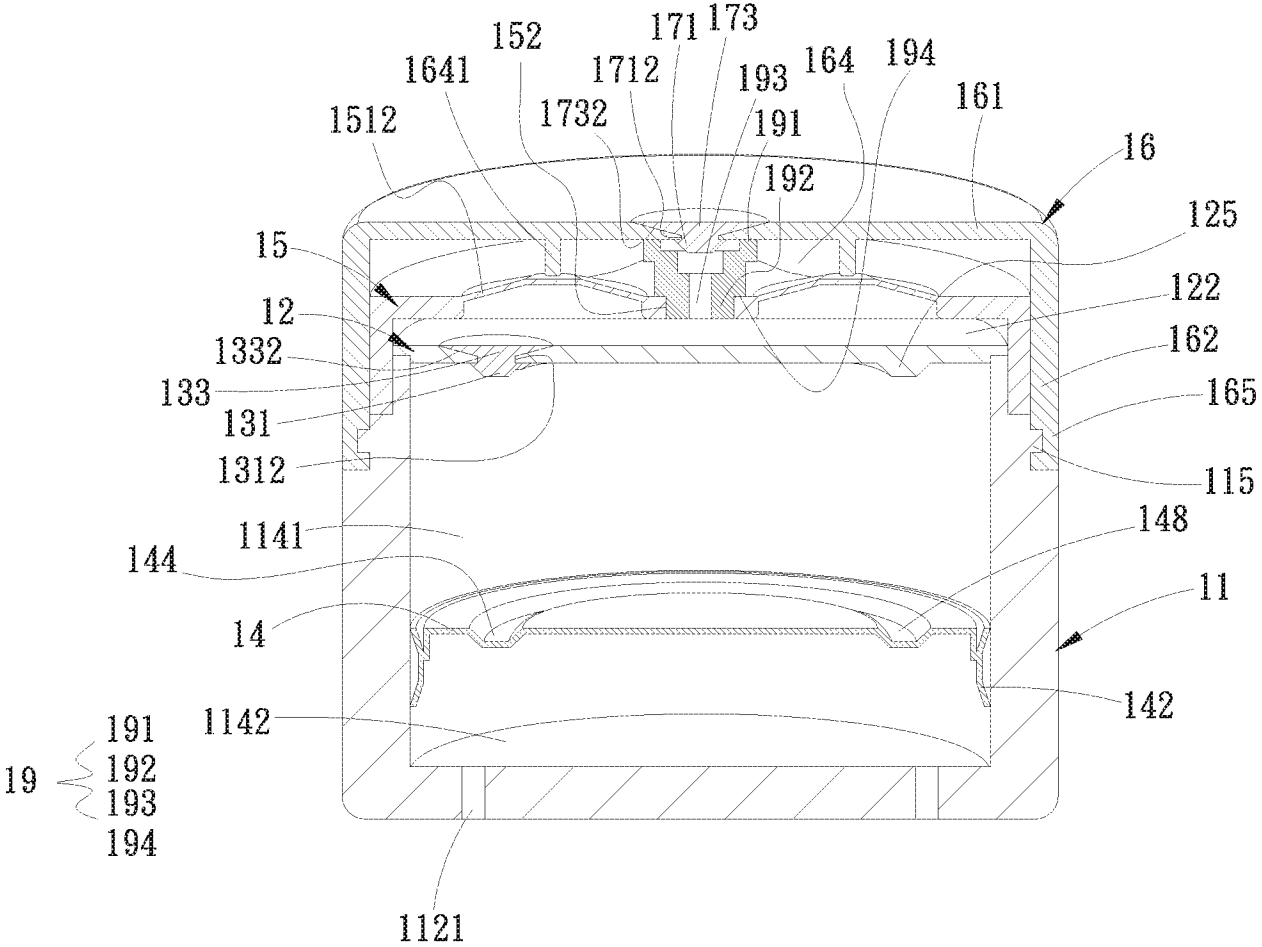
FIG. 10 is a perspective sectional assembled view of a fourth embodiment of the vacuumed container of the present invention.
Figure 11:
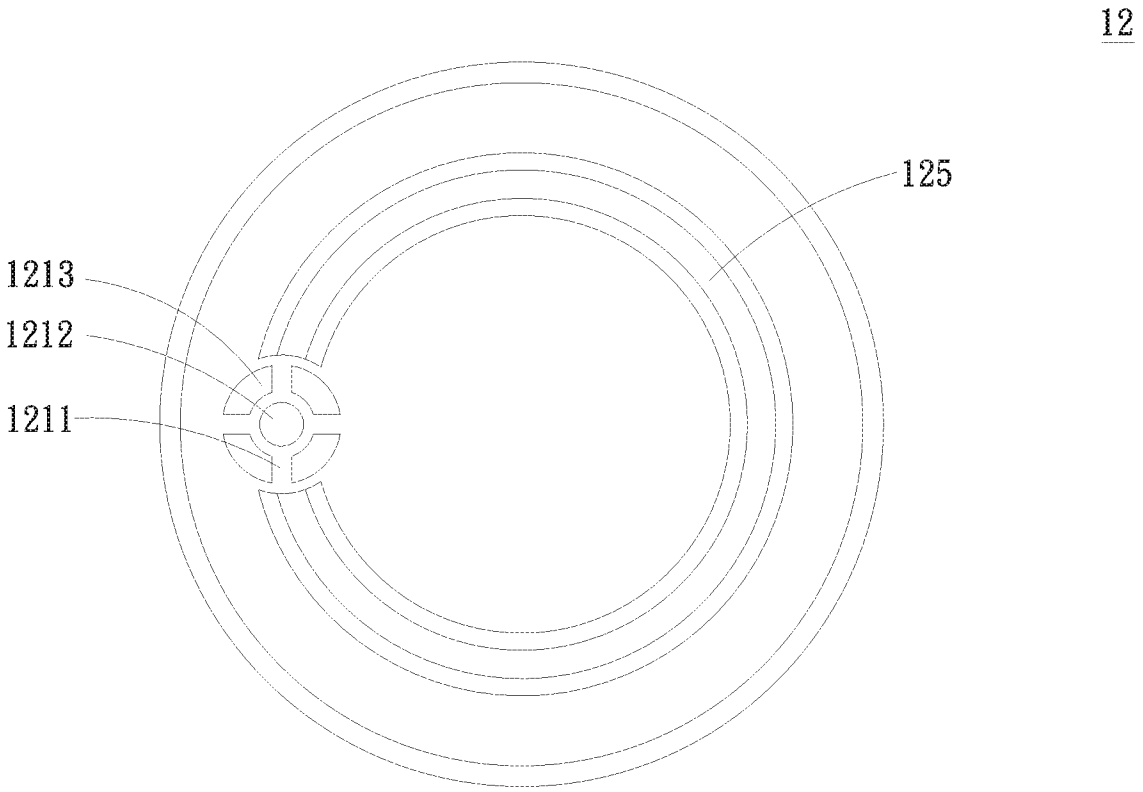
FIG. 11 is a bottom view of the connection member of the fourth embodiment of the vacuumed container of the present invention.

Please now refer to FIGS. 10 and 11. FIG. 10 is a perspective sectional assembled view of a fourth embodiment of the vacuumed container of the present invention. FIG. 11 is a bottom view of the connection member of the fourth embodiment of the vacuumed container of the present invention. Also referring to FIGS. 1-6, the fourth embodiment is partially identical to the first embodiment in structure and function and thus will not be redundantly described hereinafter. The fourth embodiment is different from the first embodiment in that the connection member 12 is formed with an annular rib 125 protruding toward the first chamber 1141. The installation sink 121 is positioned in the annular rib 125. The piston 14 is formed with an annular groove 148 corresponding to the annular rib 125 and the first support valve seat 131 of the first valve member 13. In addition, the first support valve seat 131 and the annular rib 125 can be correspondingly separably connected with the annular groove 148.

When using the content 2 in the first chamber 1141, the piston 14 will continuously move upward under pressure until the content 2 in the first chamber 1141 is exhausted. At this time, the connection member 12 will connect with the piston 14 and the first support valve seat 131 of the first valve member 13 and the annular rib 125 will correspondingly attach to the annular groove 148 of the piston 14. Under such circumstance, the content 2 in the first chamber 1141 can be totally squeezed out to the third chamber 122 without residual. In addition, when moving upward, the piston 14 can keep in balance.

Figure 12:
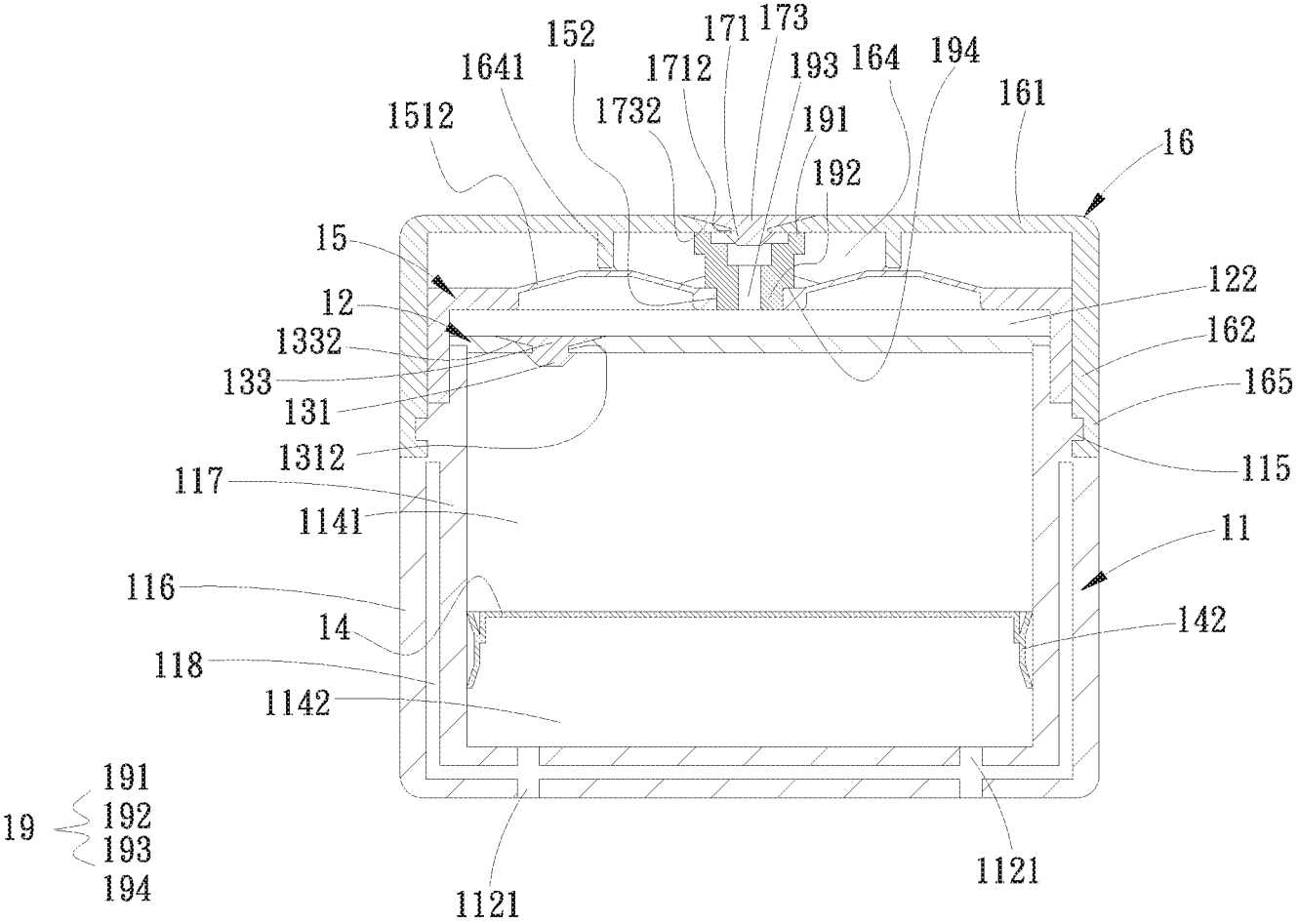
FIG. 12 is a sectional assembled view of a fifth embodiment of the vacuumed container of the present invention.

Please now refer to FIG. 12, which is a sectional assembled view of a fifth embodiment of the vacuumed container of the present invention. Also referring to FIGS. 1-6, the fifth embodiment is partially identical to the first embodiment in structure and function and thus will not be redundantly described hereinafter. The fifth embodiment is different from the first embodiment in that the container main body 11 has an outer layer 116 and an inner layer 117. A hollow layer 118 defined between the outer and inner layers 116, 117. The inner layer 117, the open end 111 and the closed end 112 together define the receiving space 114. The at least one perforation 1121 of the inner layer 117 and the at least one perforation 1121 of the outer layer 116 communicate with the hollow layer 118 and the second chamber 1142.

The material of the container main body 11 in the position of the hollow layer 118 is saved so that the manufacturing cost of the container main body 11 is lowered.

Figure 13:
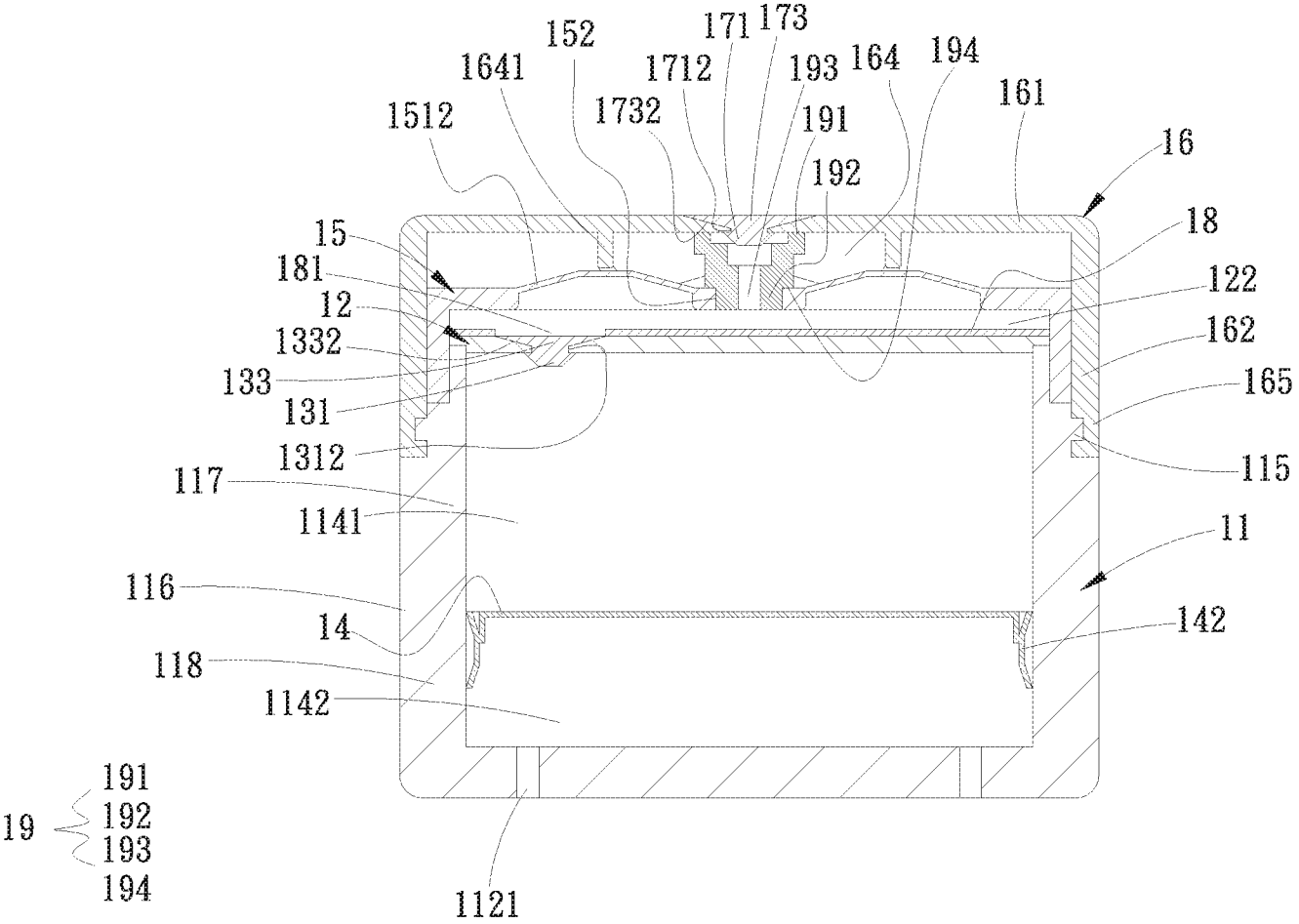
FIG. 13 is a sectional assembled view of a sixth embodiment of the vacuumed container of the present invention.

Please now refer to FIG. 13, which is a sectional assembled view of a sixth embodiment of the vacuumed container of the present invention. Also referring to FIGS. 1-6, the sixth embodiment is partially identical to the first embodiment in structure and function and thus will not be redundantly described hereinafter. The sixth embodiment is different from the first embodiment in that the vacuumed container 1 further includes a sealing member 18 disposed in the third chamber 122 in a position where the connection member 12 and the pressurized cap 15 are connected. In this embodiment, the sealing member 18 is a sheet body disposed in the third chamber 122 in attachment to an upper side of the connection member 12. The sealing member 18 is formed with a hole 181 in the position of the first installation sink 121 in communication with the third chamber 12. A periphery of the sealing member 18 seals the connection position between the pressurized cap 15 and the connection member 12 so as to enhance the sealability of the third chamber 122.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A vacuumed container comprising:

a container main body having an open end and a closed end, the open end and the closed end together defining a receiving space, the closed end being formed with at least one perforation;

a connection member disposed on the open end, the connection member having a first installation sink, a first valve member being disposed in the first installation sink;

a piston movably received in the receiving space and displaceable with the operation of the first valve member, the piston and the corresponding connection member defining therebetween a first chamber in communication with the first installation sink, the piston and the corresponding closed end defining therebetween a second chamber in communication with the at least one perforation, the first and second chambers being isolated from each other;

a pressurized cap disposed at the open end of the container main body corresponding to the connection member, the pressurized cap and the connection member together defining a third chamber, the pressurized cap having a pressurized section and a second installation hole, the pressurized section being disposed on one side of the pressurized cap, the second installation hole passing through the pressurized cap in communication with the third chamber;

an upper cap capping the pressurized cap, the upper cap having a top wall and a circumferential wall downward extending from a rim of the top wall, the top wall having a second installation sink corresponding to the second installation hole, a second valve member being disposed in the second installation sink, an inner side of the top wall having an abutment ring, one end of the abutment ring contacting the pressurized section, whereby the pressurized section is pressed by the abutment ring to elastically deform to make the second valve member operate therewith; and a connection component having a first end, a second end and a flow way passing through the first and second ends, the first end abutting against the inner side of the top wall along an outer rim of the second installation sink, the second end being disposed in the second installation hole of the pressurized cap, the flow way communicating with the second installation sink and the second installation hole.

2. The vacuumed container as claimed in claim 1, wherein the first installation sink has a first base seat, a first installation hole and multiple first through holes, the first installation hole and the first through holes passing through the first base seat, the second installation sink having a second base seat, a third installation hole and multiple second through holes, the third installation hole and the second through holes passing through the second base seat.

3. The vacuumed container as claimed in claim 2, wherein the first valve member is disposed on one side of the first installation sink, the first valve member having a first support valve seat and a first valve plate, the first support valve seat protruding from one side of the first valve plate toward the first chamber, the first support valve seat having a first depression, the first depression being inward recessed along an outer side of the first support valve seat, the first support valve seat passing through the first installation hole of the first installation sink, whereby the first depression is engaged with the first base seat.

4. The vacuumed container as claimed in claim 3, wherein the second valve member is disposed on one side of the second installation sink, the second valve member having a second support valve seat and a second valve plate, the second support valve seat protruding from one side of the second valve plate toward the pressurized cap, the second support valve seat having a second depression, the second depression being inward recessed along an outer side of the second support valve seat, the second support valve seat passing through the third installation hole of the second installation sink, whereby the second depression is engaged with the second base seat.

5. The vacuumed container as claimed in claim 3, wherein the first valve plate has a first contact face separably attached to the first base seat of the first installation sink, the first contact face being elastically deformable to separate from the first base seat of the first installation sink.

6. The vacuumed container as claimed in claim 4, wherein the second valve plate has a second contact face separably attached to the second base seat of the second installation sink, the second contact face being elastically deformable to separate from the second base seat of the second installation sink.

7. The vacuumed container as claimed in claim 1, wherein the piston is equipped with a sealing ring disposed on an outer circumference of the piston, one side of the sealing ring being tightly attached to an inner circumference of the container main body so as to isolate the first and second chambers from each other.

8. The vacuumed container as claimed in claim 1, wherein the pressurized section of the pressurized cap has multiple first trough sections and multiple first crest sections, the first crest sections protruding toward the upper cap, the first trough sections and the first crest sections being alternately arranged.

9. The vacuumed container as claimed in claim 1, wherein the abutment ring of the upper cap has multiple second trough sections and multiple second crest sections, the second crest sections protruding toward the pressurized cap, the second trough sections and the second crest sections being alternately arranged.

10. The vacuumed container as claimed in claim 3, wherein the piston is formed with a first recess in a position corresponding to the first support valve seat, the first recess being downward recessed toward the second chamber, whereby the first support valve seat can be correspondingly separably connected with the first recess.

11. The vacuumed container as claimed in claim 10, wherein the connection member is formed with a balancing block in a position symmetrical to the first installation sink, the balancing block protruding toward the first chamber, the balancing block having a protrusion section, the piston being formed with a second recess in a position symmetrical to the first recess, the second recess being downward recessed toward the second chamber, whereby the balancing block can be correspondingly separably connected with the second recess.

12. The vacuumed container as claimed in claim 1, wherein the connection member is formed with an annular rib protruding toward the first chamber, the first installation sink being positioned in the annular rib, the piston being formed with an annular groove corresponding to the annular rib and a first support valve seat of the first valve member, whereby the first support valve seat and the annular rib can be correspondingly separably connected with the annular groove.

13. The vacuumed container as claimed in claim 1, wherein the outer circumference of the open end of the container main body is formed with a first engagement section and the inner circumference of the upper cap has a second engagement section, the first engagement section being correspondingly rotatably engaged with the second engagement section.

14. The vacuumed container as claimed in claim 13, wherein the first engagement section is one of an annular rib and an annular groove, while the second engagement section is the other of the annular rib and the annular groove.

15. The vacuumed container as claimed in claim 1, wherein an outer circumference of the connection component has a stepped section positioned between the first and second ends, the second end being plugged in the second installation hole of the pressurized cap, the stepped section abutting against the upper side of the pressurized cap along the outer rim of the second installation hole.

16. The vacuumed container as claimed in claim 1, wherein the container main body has an outer layer and an inner layer, a hollow layer being defined between the outer and inner layers, the inner layer, the open end and the closed end together defining the receiving space, the at least one perforation of the inner layer and the at least one perforation of the outer layer communicating with the hollow layer and the second chamber.

17. The vacuumed container as claimed in claim 1, further comprising a sealing member disposed in the third chamber in a position where the connection member and the pressurized cap are connected.

* * * * *